United States Patent [19]

Enomoto et al.

[11] Patent Number: 4,772,336

[45] Date of Patent: Sep. 20, 1988

[54] METHOD OF IMPROVING RESIDUAL STRESS IN CIRCUMFERENTIAL WELD ZONE

[75] Inventors: Kunio Enomoto, Ibaraki; Tasuku Shimizu, Hitachi; Shinji Sakata, Katsuta; Terunobu Koike, Nakaminato; Nobuo Shimizu; Tsukasa Ikegami, both of Hitachi, all of Japan

[73] Assignee: Hitachi, Ltd., Tokyo, Japan

[21] Appl. No.: 15,624

[22] Filed: Feb. 17, 1987

Related U.S. Application Data

[63] Continuation of Ser. No. 658,170, Oct. 5, 1984, abandoned.

[30] Foreign Application Priority Data

Oct. 5, 1983 [JP] Japan ..... 58-185062

[51] Int. Cl.[4] ..... C21D 9/50

[52] U.S. Cl. ..... 148/11.5 Q; 148/127; 148/154

[58] Field of Search ..... 148/11.5 Q, 127, 131, 148/154, 13, 13.1, 130; 219/10.41, 10.57, 10.61

[56] References Cited

U.S. PATENT DOCUMENTS

| | | | |
|---|---|---|---|
| 4,168,190 | 9/1979 | Eguchi et al. | 148/136 |
| 4,229,235 | 10/1980 | Matsuda et al. | 148/127 |
| 4,354,883 | 10/1982 | Terasaki | 148/127 |
| 4,505,763 | 3/1985 | Sugihara et al. | 148/127 |

*Primary Examiner*—Christopher W. Brody

*Attorney, Agent, or Firm*—Antonelli, Terry & Wands

[57] ABSTRACT

A method for improving residual stress in a circumferential weld zone of a piping and the like which includes preventing deformation of the weld zone, and causing a local expansion or contraction of a portion of the piping axially spaced from the weld zone thereby effecting a plastic working so as to increase or decrease the diameter of piping. The method can effectively be applied to apparatus and pipe system which are used in a corrosive environment and under action of a static or dynamic outer load.

9 Claims, 10 Drawing Sheets

RESIDUAL STRESS DISTRIBUTION IN SHELL INNER SURFACE AFTER WELDING

RESIDUAL STRESS DISTRIBUTION IN IHSI SHELL INNER SURFACE (Type-5)

METHOD OF IMPROVING RESIDUAL STRESS IN CIRCUMFERENTIAL WELD ZONE

This is a continuation of application Ser. No. 658,170, filed Oct. 5, 1984, abandoned.

BACKGROUND OF THE INVENTION

The present invention relates to a method of improving tensile residual stress in a circumferential weld zone for connecting a piping or in a circumferential weld zone of a cylindrical vessel and, more particularly, to a method of improving residual stress in a circumferential weld zone of two members one of which has a high rigidity.

Generally, tensile residual stress in the order of yield stress of the material being used exists in the inner and outer surfaces of weld zone, with the tensile residual stress causing fatigue failure, stress corrosion or the like to the weld zone of the vessel or piping depending on the condition in use of the apparatus, resulting in a low availability factor of the apparatus. The stress corrosion cracking caused in the weld zone of piping of a stainless steel SUS 304 in the primary cooling system piping of a nuclear power generation plant with boiling water reactor is typically susceptible to tension residual stress resulting in decreasing the availability factor of power generation plant. In order to prevent stress corrosion cracking, various studies have been made to develop methods for reducing the tensile residual stress in the weld zone of piping. As a result, a stress-improving method using a high-frequency induction heating was developed as a counter measure method for an already existing and operating plant and has been used in many actual plants. This method comprises the steps of providing around the outer periphery of the annular circumferential weld zone of pipes a high-frequency induction heating coil for local heating, and rapidly heating the weld zone through a high-frequency induction heating device and a cable while cooling the inner surface of pipes by a coolant. By this rapid heating, such a temperature difference occurs in the direction of wall thickness that the temperature at the outer surface of the weld zone becomes high and that at the inner surface of the same becomes low. Consequently, a tensile stress occurs in the inner surface due to the heating, and when a temperature differential between the inner and outer surfaces of piping is about 200° C., a tensile yield occurs in the inner surface thereby causing a tensile permanent set. When the heating treatment is finished and the temperature differential between the inner and outer surfaces is zero, a compressive stress occurs corresponding to the tensile permanent set brought about by the heating. Namely, the residual stress in the inner surface of the pipe which was at a tensile stress before being heated can be relieved.

However, in the case where one of two members in the circumferential weld zone has a higher rigidity than the other, the stress improvement in the inner surface cannot be obtained.

Accordingly, an object of the invention resides in providing a method of improving the residual stress, which can relieve the tensile residual stress in a circumferential weld zone between two members one of which was a higher rigidity than the other, and efficiently using stress distribution characteristics in a local bending deformation.

Another object of the invention resides providing a method of improving residual stress, which can enhance the strength against cracking and the strength against crack development in apparatus and pipe system which are used in a corrosive environment and under an action of a static or dynamic, outer load.

According to advantageous features of the invention, when outwardly concentrated loads are radially applied to the cross-section of a hollow cylinder, a local expanding deformation is caused in the inner surface of the hollow cylinder and local bending stress distributions occur therein.

DETAILED DESCRIPTION

Figure 1:
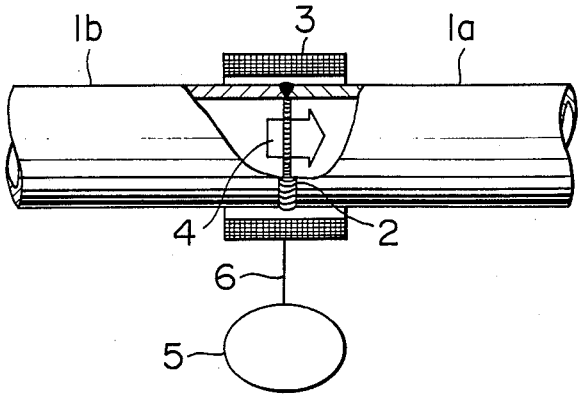
FIG. 1 PRIOR ART
FIGS. 1 and 2 are partial longitudinal cross-sectional views of prior art construction.

Referring now to the drawings wherein like reference numerals are used throughout the various views to designate like parts and, more particularly, to FIG. 1, according to this figure, stress-improving method using a high-frequency induction heating, comprises the steps of providing, around the outer periphery of the annular circumferential weld zone 2 of pipes 1*b* and 1*b*, a high-frequency induction heating coil 3 for local heating and rapidly heating the weld zone through a high-frequency induction heating device 5 and a cable 6 while cooling the inner surface of pipes 1*a* and 1*b* by a coolant 4. By the rapid heating, a temperature differential occurs in the direction of wall thickness so that the temperature at the outer surface of the weld zone is high and, at the inner surface of the same is low. Consequently, a tensile stress occurs in the inner surface due to the heating, and, when the temperature difference between the inner and outer surfaces of piping is in the order of 200° C., a tensile yield occurs in the inner surface thereby causing a tensile permanent set. When the heating treatment is finished and the temperature difference between the inner and outer surfaces becomes zero, a compressive stress occurs corresponding to the tensile permanent set brought about by the heating. Namely, the residual stress in the inner surface of the pipe which was at a tensile stress before being heated, can be relieved.

Figure 2:
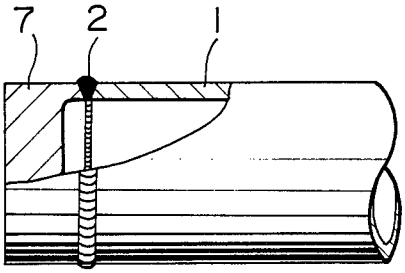
FIG. 2 PRIOR ART
Figure 3A:
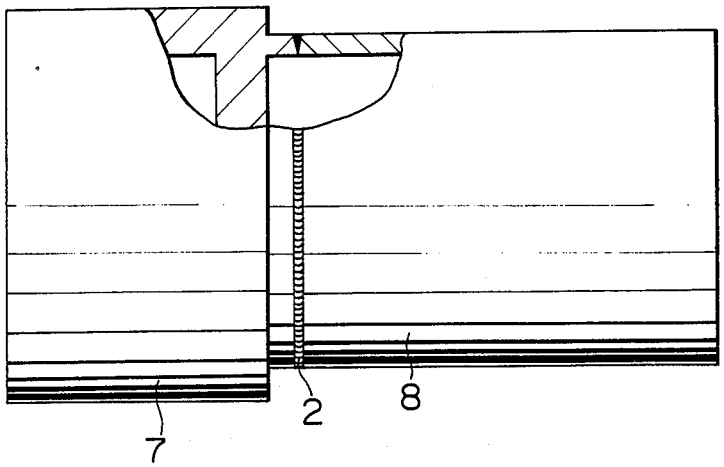
FIG. 3*a* is a partial cross-sectional view of a construction similar to FIG. 2 for detecting the residual stress distributions due to welding.
Figure 3B:
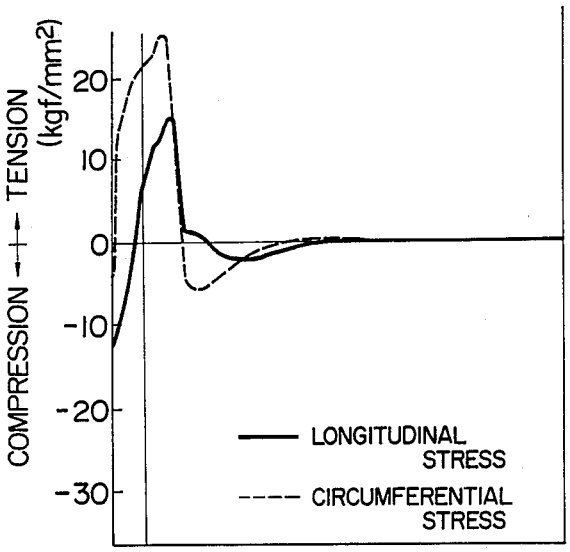
FIG. 3*b* is a graphical illustration of the actual residual stress distributions.
Figure 4A:
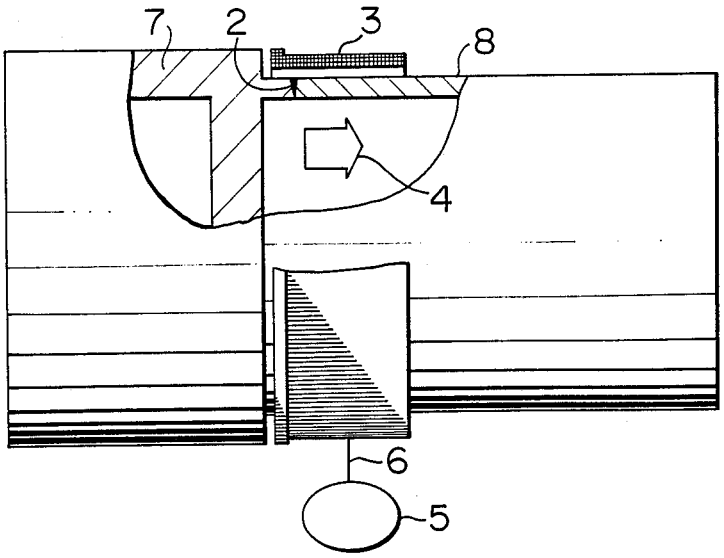
FIG. 4*a* is an a partial cross-sectional view depicting a case where a conventional method is applied to the weld zone shown in FIG. 3*a;*
Figure 4B:
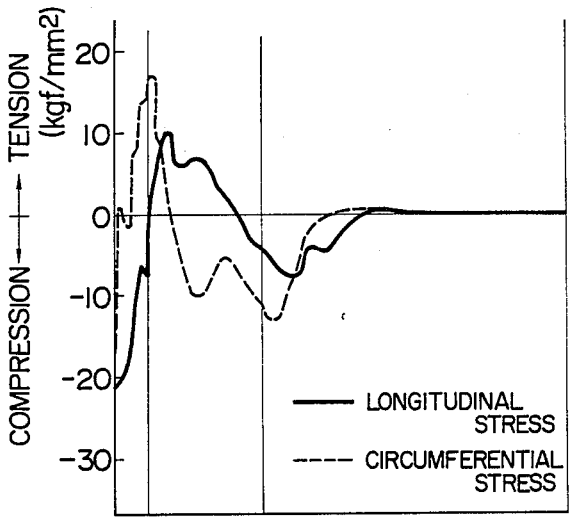
FIG. 4*b* is a graphical illustration of residual stress distributions showing the result of the stress-improving treatment conducted in accordance with the method of FIG. 4*a;*

However, as shown in FIG. 2, where one member 7 in the circumferential weld zone has a higher rigidity than the other member 1, the stress improvement in the inner surface can not be obtained. For example, the weld zone 2 shown in FIG. 3*a* and has a residual stress distribution such as shown in FIG. 3*b*. As shown in FIG. 4*a* with the heating coil 3 arranged in a manner shown in FIG. 1, the weld zone 2 is rapidly heated to about 500° C. at its outer surface, resulting in a relieving of the tensile residual stress as shown in FIG. 4*b*, but not achieving a remarkable improving effect. In situations wherein one member 7 to be welded has a higher rigidity than the other member 8, the residual stress in weld zone 2 can not be sufficiently relieved by the conventional method.

Figure 5:
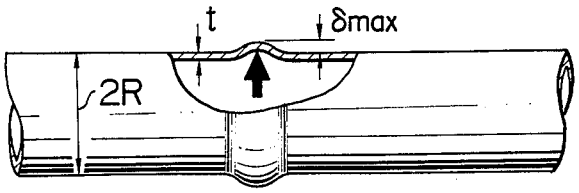
FIG. 5 is a partial cross-secional view of the basic concept of the method of the invention.
Figure 6:
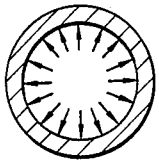
FIG. 6 is a cross-sectional view taken along the central portion of the pipe shown in FIG. 5.
Figure 7:
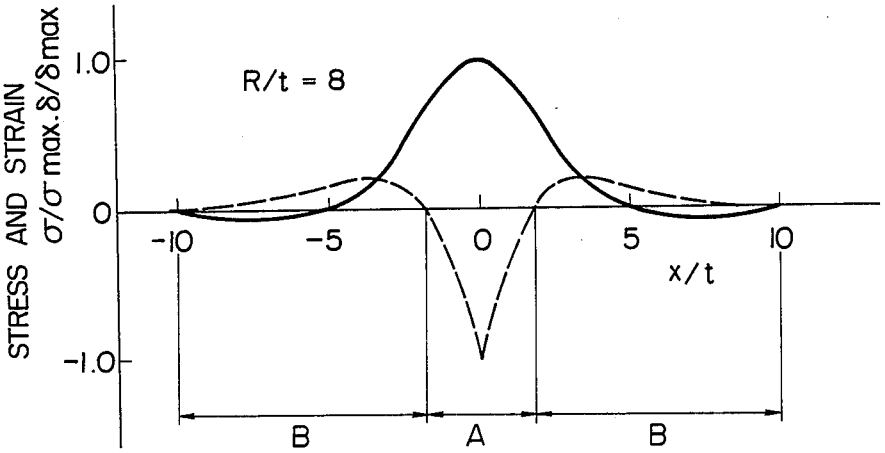
FIG. 7 is a graphical illustration of the stress distributions in the inner surface of the pipe shown in FIG. 5 along the length thereof.
Figure 8:
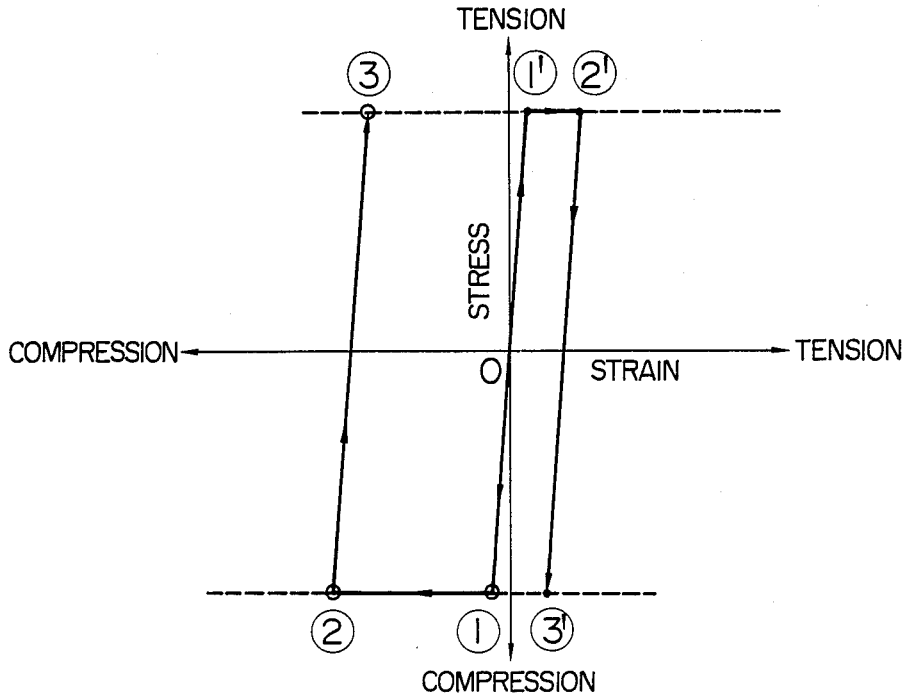
FIG. 8 is a graphical illustration depicting the behavior between stress and strain, for explaining the effect of the invention.

As shown in FIGS. 5 and 6 in accordance with the present invention when outwardly concentrated loads are radially applied to the cross-section of a hollow cylinder, a local expanding deformation is caused in the inner surface of the hollow cylinder and local bending stress distribution such as shown in FIG. 7 occur therein. Namely, for the inner surface, a compressive stress occurs in the region A of $|x/t| \lesssim 2$, whereas a tensile stress occurs in the region B of $2 < |x/t| \lesssim 10$. In FIG. 7, the solid line represents the strain distribution and the dotted line represents the stress distribution in the inner surface which is schematically shown in FIG. 8. Namely, the hysteretic route 0→①→②→③ represents a behavior of the region A in which, by the load, a compressive stress is applied thereby causing the compressive yield ① and the compressive plastic strain ② and then the compressive stress decreases as the load is removed and when the load is completely removed the tensile stress ③ remains. On the other hand, the hysteretic route 0→①'→②'→③' represents a behavior of the region B in which by the load a tensile stress is applied thereby causing the tensile yield ①' and the tensile plastic strain ②' and then the tensile stress decreases as the load is removed and when the load is completely removed the compressive stress ③' remains. By virtue of the invention aforesaid aspect, i.e., when the load is applied under such a condition that the circumferential weld zone in which a tensile residual stress exists coincides with the region B, the tensile residual stress ②' occurs by a small load because in the region B the state ①' exists at the start of application of load, and when the load is removed the state ③' occurs, so that it is possible to improve the tensile residual stress state ①' to the compressive residual stress state ③' by the small load.

Figure 9A:
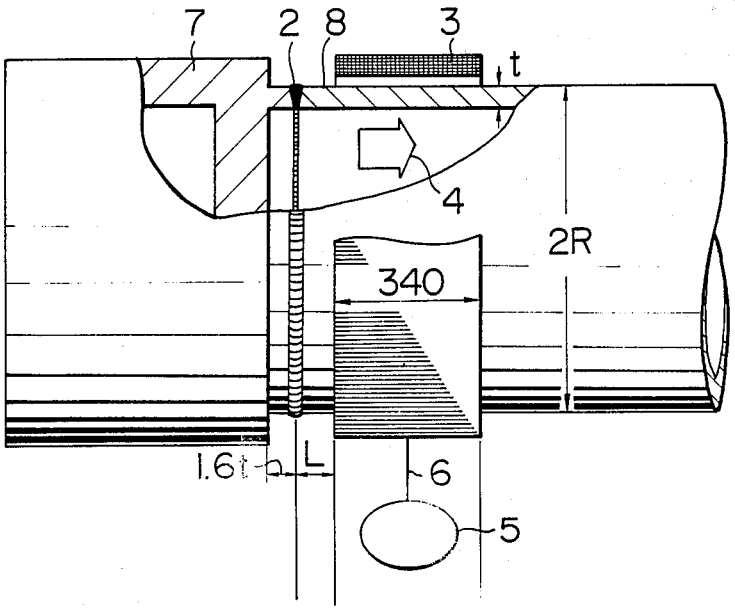
FIG. 9*a* is a partial cross-sectional view of an embodiment of the invention.
Figure 9B:
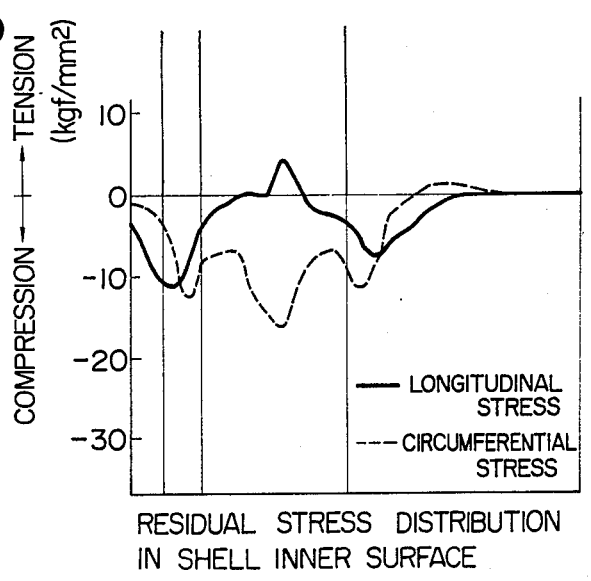
FIGS. 9*b* to 9*d* are graphical illustrations of the effects of the embodiment shown in FIG. 9*a;*

FIG. 9*a* provides an illustrated example of an embodiment of the invention applied to a circumferential weld zone between a tube plate 7 a shell 8 of a heat exchanger. In the prior art, it has not been possible to satisfactorily improve the residual stress in the circumferential weld zone of the type illustrated in FIG. 9*a*. In this embodiment, a means for imparting a local expanding deformation of FIGS. 5 and 6 includes a heating coil 3 surrounding and spaced from the circumferential weld zone 2 by a distance L which is given by $L=0.54\sqrt{Rt}$ or by $L=2t$, where R represents the radius of the shell, while t represents the wall thickness of the shell. The coil 3 is energized by a high-frequency induction heating device 5 through cable 6. In operation, the coil 3 is excited by a high-frequency current so that a high-frequency current is induced in the portion of the shell 8 covered by the coil 3 to heat this portion of the shell, while the inner surface is cooled by a coolant such as still water, flowing water, sprayed water and the like. Since the inner surface is cooled so that a temperature differential occurs in the wall thickness, and an expanding deformation approximately corresponding to a average temperature is caused in the portion of shell covered by the coil thereby causing a local bending action in the vicinity of each axial end of the coil 3, so that the effect mentioned in the foregoing paragraph can be obtained. This local bending action is larger at the an axial end of the coil 3 in the side at which the weld zone exists than at the coil's other axial end. FIG. 9*b* shows the residual stress distributions in the inner surface when the shell is heated until the average temperature in the wall thickness of fthe shell covered by the coil 3 becomes 350° C. By comparing FIG. 9*b* with FIG. 3*b*, it will be seen that, by virtue of the invention, the tensile residual stress due to welding is relieved to the compressive residual stress. Further, by comparing with FIG. 4, the difference from the prior art can also be clearly recognized.

Figure 9C:
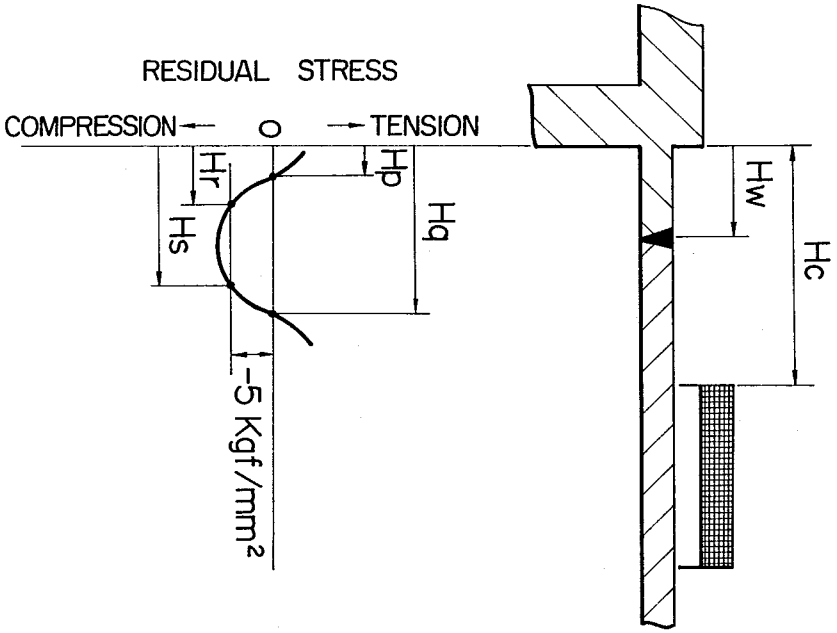
Figure 9D:
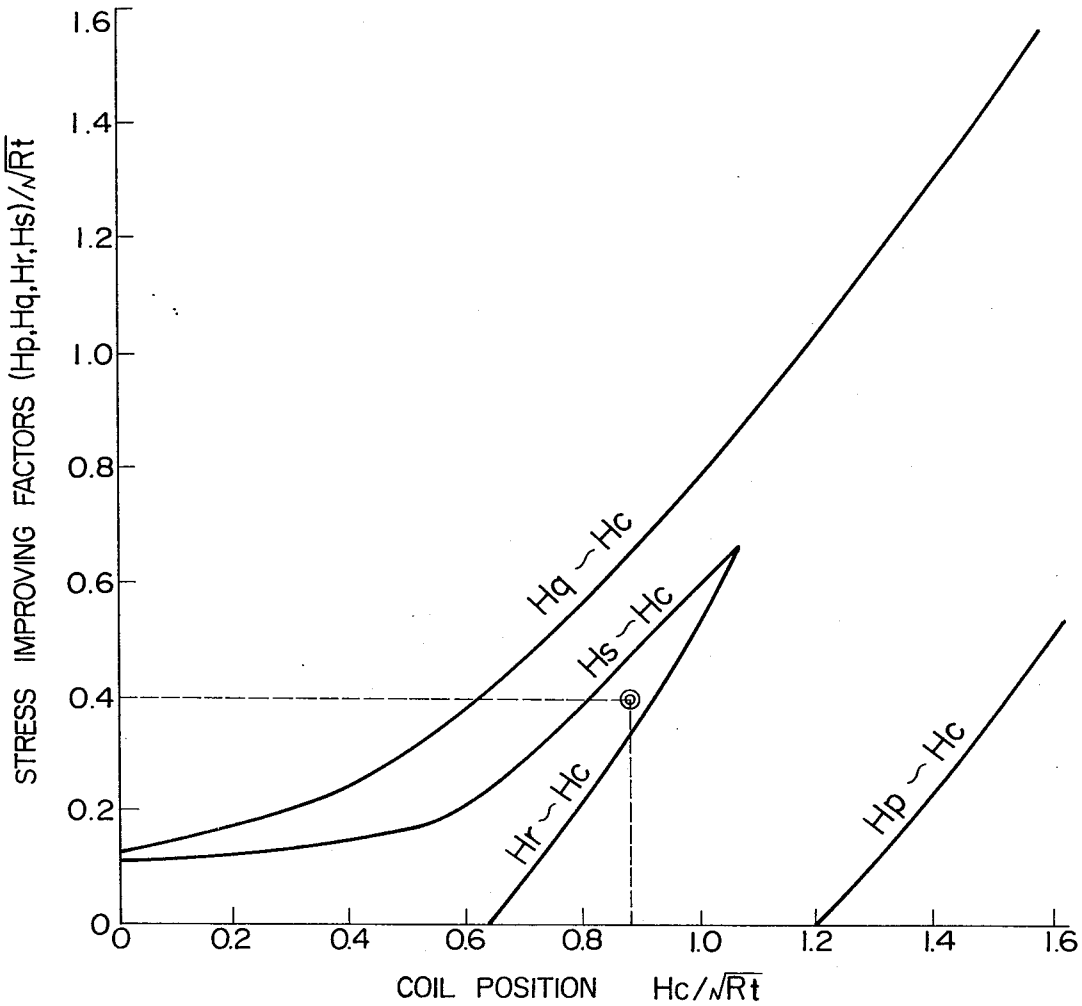

Since the effectiveness has been confirmed, next, the results of analysis on the optimum position of the coil 3 are described hereinbelow. FIG. 9*c* shows a general tendency of the residual stress distribution when the distance Hc between the tube plate's end face (a portion where the rigidity drastically changes from a high level to a low level) and the axial end of the coil 3 has been made large, and represents a fact that when the distance Hc is too large the tensile residual stress occurs in the vicinity of the end of the tube plate face, so that it becomes harmful. Defining that, on the basis of the tube plate's end face, Hq is a point at which the stress changes from tensile stress to compressive stress, that Hg is a point at which the stress reversely changes from compressive stress to tensile stress, and further that Hr and Hs are points at which the compressive stress starts to become lower than $-5$ Kgf/mm$^2$ and higher than $-5$ Kgf/mm$^2$, respectively. The parameters are represented, in FIG. 9*d*, on the axis of odinate in terms of $(Hp, Hq, Hr, Hs)/\sqrt{Rt}$ and the coil position Hc is represented on the axis of abscissa in terms of $Hc/\sqrt{Rt}$. From this, it will be seen that under a condition of $Hc/\sqrt{Rt} \geqq 1.2$ the stress improvement in the vicinity of the tube plate's end face can not be obtained. From FIG. 9*d*, the optimum position of coil 3 can be determined in such a manner as mentioned hereinafter. Namely, assuming in FIG. 9*c* that the welding position is Hw, when the value $Hw/\sqrt{Rt}$ is 0.4, for example, the value $Hw/\sqrt{Rt}=0.4$ is plotted on the axis of ordinate in FIG. 9*d* and then the coil may be set to the value $Hc/\sqrt{Rt}=0.88$ which corresponds to a central point (represented by double circle mark) between the curve Hr−Hc and the curve Hs−Hc. As an actual value of Hw, the value $Hw/\sqrt{Rt}=0.2$ to 0.5 is often adopted, and when it is assumed as a stress improving effect that the compressive residual stress of about $-5$ Kgf/mm$^2$ is a standard, it is concluded that the optimum coil position corresponds to the value $Hc/\sqrt{Rt}=0.81$ to 0.92.

Since the shell 8 is heated while cooling its inner surface, in the portion of shell covered by the coil 3 such a temperature differential ΔT in the wall thickness occurs that the temperature is high in the outer surface and low in the inner surface. In the case of a mere expanding deformation, a tensile residual stress occurs in the aforesaid portion as in the region A explained above but since there is the temperature differential ΔT such an advantage is brought about that when the shell is heated the tensile yield occurs in the inner surface and finally the compressive stress remains therrein. Further, this advantage is promoted by the fact that the high-frequency heating is in itself a heating method which can easily cause the temperature differential ΔT because the heat is generated in surface layer of the shell 8.

Figure 10:
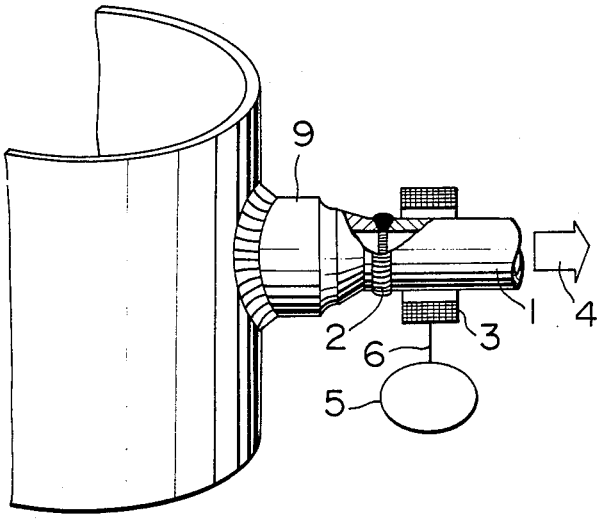
FIG. 10 is a partial cross-sectional view of an example of the application of the invention.

The invention can be applied not only to the case where the rigidities of two members to be welded are extremely different as in the circumferential weld zone 2 between the tube plate 7 and the shell 8 but also to the circumferential weld zone 2 between a nozzle 9 and a pipe 1 as shown in FIG. 10.

Figure 11:
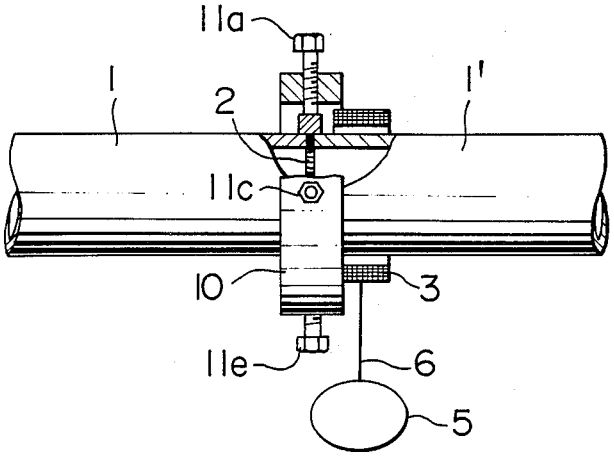
FIG. 11 is a partial cross-sectional view of a modified embodiment of the invention.
Figure 12:
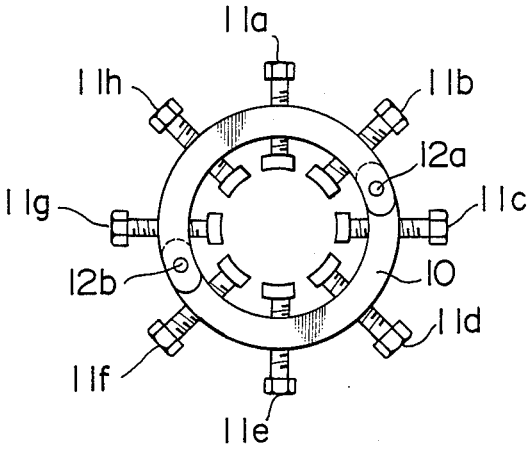
FIG. 12 is a schematic detail of deformation preventing clamp used in the embodiment of FIG. 11.

Further, in the case where the difference in rigidity between both sides of the circumferential weld zone is small, it is possible to enhance the local bending action as shown in FIG. 11, by providing a deformation preventing means on a side of the heating coil 3 facing to the circumferential weld zone 2. In the embodiment of FIG. 11, the deformation is prevented by providing a detachable clamp 10 including two halves connected with pins 12*a*, and 12*b* and threadably securing the clamping bolts 11*a* to 11*h*. FIG. 12 shows the deformation preventing clamp in its as-detached state. Hydraulic cylinders may be provided in place of the clamping bolts. the advantage of the detachable clamp 12 resides in the fact that, by threadably attaching the clamping bolts 11*a* to 11*h*, a tensile stress occurs in the inner surface of weld zone 2 and it is possible, in cooperation with the local bending action brought about by heating with the coil 3, to enhance the effect of improving the residual stress to the compressive residual stress.

In the abovementioned embodiments, the high-frequency heating with cooling of the inner surface is utilized as a means for imparting the local expanding deformation, but even if the cooling is omitted the present invention can nevertheless improve a reduction in the tensile residual stress due to welding.

Further, as may be understood from all of the embodiments mentioned hereinbefore, since it is not necessary to use inside a pipe or vessel a special means, the characteristic of the abovementioned embodiments resides in a point that the invention can be applied to an already complete piping or vessel without disassembling or cutting the same.

What is claimed is:

1. A method for improving residual stress of a weld zone between two stainless steel cylinders, one of which has a higher rigidity than the other, the method comprising the steps of: spacing an induction heating coil from the weld zone by a distance of $0.54\sqrt{Rt}$ in a longitudinal direction of the cylinders, where R equals a radius of a cylinder, and t equals a wall thickness of the cylinder, heating the outer surface of the other cylinder by using the induction heating coil, and cooling the inner surface of the other cylinder during the induction heating.

2. A method for improving residual stress in the circumferential weld zone of a cylindrical apparatus, the method comprising the steps of: providing a means for preventing a deformation of said weld zone; causing a portion of one of said cylinders which is axially spaced from said weld zone by a predetermined distance to locally expand or contract by induction heating to thereby effect a plastic working so as to increase or decrease the diameter of the cylinder, said predetermined distance being a distance of $0.54\sqrt{Rt}$ in a longitudinal direction of the cylinder, where R equals a radius of the cylinder and t equals a wall thickness of the cylinder; and cooling an inner surface of the other cylinder during the induction heating.

3. A method according to claim 1, wherein one of said cylinders is a tube plate of a heat exchanger.

4. A method according to claim 2, wherein one of said cylinders is a tube plate of a heat exchanger.

5. A method according to claim 1, wherein the spacing step is effected such that the axial faces of the coil surround the other cylinder and are spaced from the weld zone.

6. A method according to claim 1, wherein the heating step is effected so as to apply a radially outwardly concentrated load to aa cross-section of the other cylinder and thereby cause a local expanding deformation in an inner surface of the other cylinder such that local bending stress distributions occur therein to improve the residual stress.

7. A method according to claim 1, wherein the heating step is effective to heat only the outer surface of the other cylinder.

8. A method according to claim 3, wherein the heating step is continued until an average temperature of 350° C. in a wall of other cylinder is reached.

9. A method according to claim 4, wherein the induction heating is continued until an average temperature of 350° C. in a wall of said one of said cylinders is reached.

* * * * *